United States Patent [19]

Terai et al.

[11] 3,974,881

[45] Aug. 17, 1976

[54] BULLDOZER BLADE MOUNTING

[75] Inventors: Akio Terai; Michiya Tanaka; Yasuhiro Todorobaru; Tuneo Sugihira, all of Hirakata, Japan

[73] Assignee: Kabushiki Kaisha Komatsu Seisakusho, Tokyo, Japan

[22] Filed: June 9, 1975

[21] Appl. No.: 584,973

[30] Foreign Application Priority Data

June 7, 1974 Japan ..... 49-63911
June 7, 1974 Japan ..... 49-63912

[52] U.S. Cl. ..... 172/803
[51] Int. Cl.[2] ..... E02F 3/76
[58] Field of Search ..... 172/801, 803–807

[56] References Cited

UNITED STATES PATENTS

| | | | |
|---|---|---|---|
| 3,395,764 | 8/1968 | Wirt | 172/803 |
| 3,441,092 | 4/1969 | Drone | 172/803 |
| 3,503,457 | 3/1970 | Smith et al. | 172/803 |
| 3,590,929 | 7/1971 | Wirt | 172/803 |
| 3,647,006 | 3/1972 | Kallenbach | 172/803 |
| 3,661,215 | 5/1972 | Pensa | 172/804 |
| 3,719,235 | 3/1973 | Marui | 172/803 |
| 3,743,032 | 7/1973 | Schick | 172/803 |
| 3,776,317 | 12/1973 | Royer | 172/803 X |

FOREIGN PATENTS OR APPLICATIONS

| | | | |
|---|---|---|---|
| 251,377 | 4/1963 | Australia | 172/806 |

*Primary Examiner*—Paul E. Shapiro
*Attorney, Agent, or Firm*—Armstrong, Nikaido & Wegner

[57] ABSTRACT

Bulldozer blade mounting including two push arms swingably mounted on the opposite sides of a tractor at their proximal ends, a blade connected to the distal ends of the arms, a tilt brace connected between the top of the respective arm and the upper side of the back of the blade, and a pair of diagonal braces each swingably connected to the respective arm and extending inwardly toward each other and connected at its inner end together by a universal pivotable means. The location of the universal pivotable means is so selected that it lies at a level higher than the plane including the pivotable connection of the respective diagonal braces to the arms. This construction eliminates the need for slidable and pivotable connection between the diagonal braces and the loose connection of the slidable and pivotable connection to the back of the blade thereby permitting the construction and assembly to be simple and the production cost to be low while proper operation of the blade mounting is insured.

3 Claims, 7 Drawing Figures

BULLDOZER BLADE MOUNTING

BACKGROUND OF THE INVENTION

The present invention relates to blade mounting in a bulldozer tractor.

Heretofore, blade mounting in a bulldozer tractor has been proposed in which a pair of push arms are pivotally mounted at their proximal ends on the opposite sides of the tractor by means of trunnions and a bulldozer blade is pivotably connected at its back to the distal ends of the arms at the respective ends of the blade and a tilt brace is provided extending between the top of each of the arms and the rear upper side of the blade at the respective ends thereof for tilting the blade around the longitudinal axis of the tractor. In such a type of the blade mounting, when a force is applied to the blade laterally of the longitudinal axis of the tractor, the blade is swung laterally of the tractor thereby resulting in breakage of the arms. In order to prevent the breakage of the arms caused by the force applied to the blade laterally of the tractor, a pair of diagonal braces are provided which are swingably mounted on the respective arms and extend inwardly toward each other with the inner ends being pivotally joined so that the lateral swunging movement of the arms is prevented by virtue of the connection of the inner ends of the diagonal braces. However, the provision of such diagonal braces obstructs the tilting operation of the blade around the longitudinal axis of the tractor.

In order to avoid the above disadvantage of the blade mounting in the prior art, a blade mounting has been proposed as disclosed in U.S. Pat. No. 3,395,764 in which each of the diagonal braces comprises a first strut pivoted to the respective arm and extending parallel to the blade and a second strut pivoted to the respective arm rearwardly of the first strut and converging forwardly to join the first strut centrally of the blade, the inner ends of the braces are joined by slidable and universally adjustable means which is also loosely connected to the back of the blade. With the arrangement of the blade mounting as described above, the stresses generated during the tilting of the blade are evenly distributed in various elements so as to prevent breakage of the elements while the tilting is freely effected and the arms are reinforced to avoid the breakage thereof by the diagonal braces when a force is applied to the blade laterally of the tractor. However, in such a construction of the blade mounting, slidable and universally adjustable connecting means is required for joining the inner ends of the diagonal braces which is also loosely connected to the back of the blade thereby requiring a large number of elements resulting in time consuming assembly and disassembly of the blade and high cost in manufacture of various elements while the elements are subjected to wear due to slidable connection between various elements.

The present invention aims at avoiding the disadvantages of the prior blade mounting in a bulldozer tractor as described above.

SUMMARY OF THE INVENTION

An object of the present invention is to provide a novel and useful blade mounting in a bulldozer tractor which avoids the disadvantages of the prior art blade mounting as described above.

Another object is to provide a novel and useful blade mounting of the type described above which is simple in construction as well as assembly and disassembly and inexpensive to manufacture and positively prevents the lengthwise movement of the blade caused by a force applied thereto in the lateral direction of the tractor while it allows free tilting operation of the blade around the longitudinal axis of the tractor without unduly stressing the various elements by evenly distributing stresses in various elements.

The above objects are achieved in accordance with the characteristic feature of the present invention by the provisions of a blade mounting including two push arms vertically swingably mounted at their proximal ends to the opposite sides of a tractor and extending forwardly, a bulldozer blade connected to the distal ends of said arms a tilt brance extending between the top of each arm and the upper side of the back of said blade for the tilting of the blade around the longitudinal axis of the tractor and a pair of diagonal braces each swingably connected at its proximal end around an axis parallel to the longitudinal axis of the respective arm on the inside of the respective arm and extending inwardly toward each other so as to be connected each other at the distal ends thereof, the blade mounting being characterized in that said pair of diagonal braces are connected at their distal ends by a universally pivotable means and the location of said universally pivotable means is so selected that it lies at a level higher than the plane including the swingable connection of the proximal ends of the diagonal braces to the arms.

By the construction of the blade mounting described above, the heretofore required complicated slidable and universally adjustable means connecting the inner ends of the diagonal braces and loosely connected to the back of the blade is dispensed with thereby permitting the number of elements to be widely reduced resulting in a low cost for manufacturing and simple assembly and disassembly of the blade while proper operation of the blade mounting is insured.

DETAILED DESCRIPTION OF THE PREFERRED EMBODIMENTS

Figure 1:
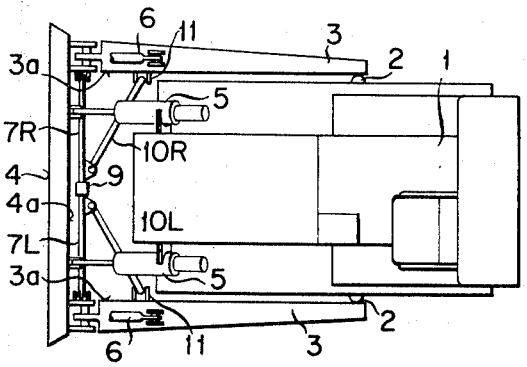
FIG. 1 is a general plan view showing a bulldozer incorporating the blade mounting of the present invention.

Referring to FIG. 1, the tractor 1 has a pair of trunnions 2 provided at the opposite sides of the tractor 1 and a pair of push arms 3, 3 are vertically pivotally mounted on the respective trunnions 2 at their proximal ends. A bulldozer blade 4 is swingably mounted at the rear side 4*a* thereof on the distal end of each of the arms 3 through universal joints such as ball joints, for example. A pair of blade lifting cylinder piston assemblies 5, 5 are pivotally connected between the forward end of the tractor 1 and the rear side 4*a* of the blade 4 so as to lift or lower the blade 4 with respect to the tractor 1 by the operation of the cylinder-piston assemblies 5, 5 as is well known in the art. A tilt brace 6 is swingably connected at its one end to the top of the respective arm 3 at the intermediate portion thereof and the other end is swingable connected to the upper portion of the rear side 4*a* of the blade 4. Either one of the tilt braces 6 is provided with a cylinder-piston assembly (not shown) operable from the operator's seat so that the blade 4 is tilted around the longitudinal axis of the tractor 1 by the operation of the cylinder-piston assembly as is well known in the art.

Figure 2:
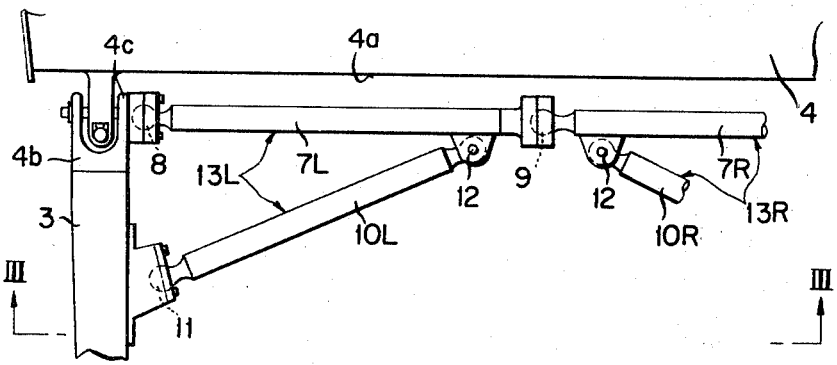
FIG. 2 is a fragmentary plan view showing the main parts of the blade mounting of the present invention.

In FIG. 2, a pair of struts 7L, 7R are swingably connected at their proximal ends by pivotable connection 8 to the inner sides 4*c* of the respective brackets 4*b* secured to the respective distal ends of the arms 3 for pivotally mounting the blade 4 thereon. The struts 7L, 7R extend parallel to the blade 4 toward each other so that the distal ends are joined together centrally of the blade 4 by universally pivotable means 9 such as a ball joint.

Figure 3:
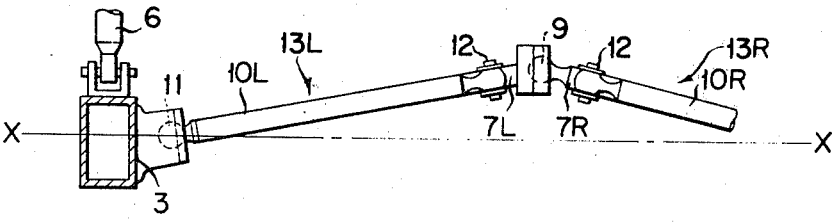
FIG. 3 is a fragmentary side view partly in section as seen in the direction of the arrows III — III in FIG. 2.

In accordance with the characteristic feature of the present invention, the universally pivotable means 9 is located at a level higher than the center line X — X connecting the pivotable connections 8 of the respective brackets 4*b*, as shown in FIG. 3.

A pair of auxiliary struts 10L, 10R are pivoted at their proximal ends by ball joints 11 at the inner sides 3*a*of the respective arms 3 at positions rearwardly of the forward ends thereof. These auxiliary struts 10L, 10R extend obliquely forwardly so that the forward ends thereof are pivotally connected by pivotable connections 12 to the distal ends of the respective struts 7L, 7R. Thus, the struts 7L and 10L constitute a diagonal brace 13L while the struts 7R and 10R constitute a diagonal brace 13R cooperating with the diagonal brace 13L.

Figure 4:
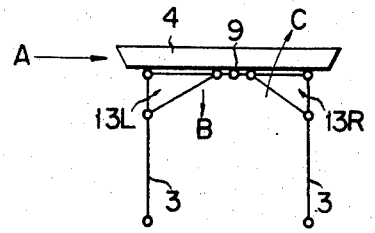
FIG. 4 is a schematic plan view showing the condition of the blade mounting of the present invention when a force is applied to the blade laterally of the longitudinal axis of the tractor.

The operation of the blade mounting of the present invention as described above is as follows:

1. When a force is applied to the blade 4 in the direction laterally of the longitudinal axis of the tractor (FIG. 4):

When a force is applied to the blade 4 in the lateral direction indicated by the arrow A with respect to the longitudinal axis of the tractor, the diagonal brace 13L tends to be rotated in the direction indicated by the arrow B while the diagonal brace 13R tends to be rotated in the direction C.

Since the inner ends of the respective diagonal braces 13L, 13R are joined together through the universally pivotable means 9, however, the diagonal braces 13L, 13R are prevented to rotate in the above described directions, thereby positively preventing the swinging movement of the push arms 3, 3 and, hence, the movement of the blade 4 in the direction indicated by the arrow A. In this case, the each of the diagonal braces 13L, 13R is subjected to a load equally divided by the universally pivotable means 9, thereby insuring even distribution of the stresses in the elements constituting the blade mounting.

Figure 5:
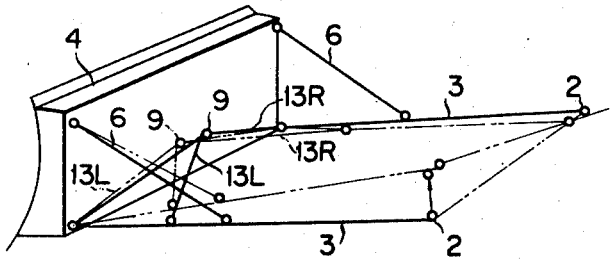
FIG. 5 is a schematic perspective view showing the condition of the blade mounting of the present invention when the blade is tiled around the longitudinal axis of the tractor.

2. When tilting of the blade is effected around the longitudinal axis of the tractor (FIG. 5):

When the blade 4 is tilted in the anticlockwise direction FIG. 5 relative to the tractor around the longitudinal axis thereof by contracting the cylinder-piston assembly provided in the left hand tilt brace 6, for example, the angle formed between the blade 4 and the respective arm 3 varies. Thus, the left and the right hand diagonal braces 13L, 13R are brought from the positions shown by full line in FIG. 5 to the positions shown by the dot-chain line in FIG. 5. At this time, the universally pivotable means 9 joining the inner ends of the diagonal braces 13L, 13R is shifted in a solid angle by the three dimensional rotation thereof, thereby absorbing the strains generated in the various elements of the blade mounting. Since the universally pivotable means 9 is located at a level higher than the plane including the pivotal connection of the proximal ends of, the diagonal braces 13L, 13R to the respective arms 3, 3, the loose connection of the universally pivotable means 9 to the blade 4 is dispensed with thereby permitting the construction to be simple and the cost for manufacture and assembly to be lowered while accurate and smooth operation of the blade mounting is insured.

Figure 6:
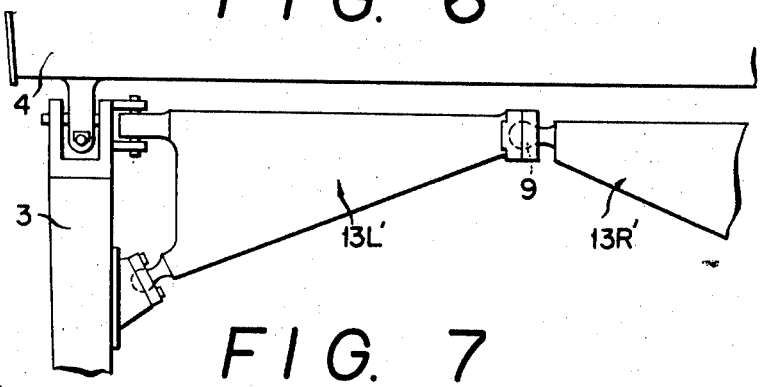
FIG. 6 is a fragmentary plan view similar to FIG. 2 but showing an alternative form of the diagonal braces.

FIG. 6 shows an alternative form of the diagonal braces. The diagonal braces 13L′, 13R′ shown in FIG. 6 comprise a pair of diagonal plates generally in the form of a right-angled triangle of the symmetrical form with one of the two sides forming the right angle therebetween of each triangle being swingably connected to the respective arm 3 at least two spaced points so as to be swung around an axis parallel to the longitudinal axis of the arm 3 while the inner end of the triangle is joined together by the universally pivotable means 9. The operation of the blade mounting shown in FIG. 6 is similar to that shown in FIGS. 1 to 5.

Figure 7:
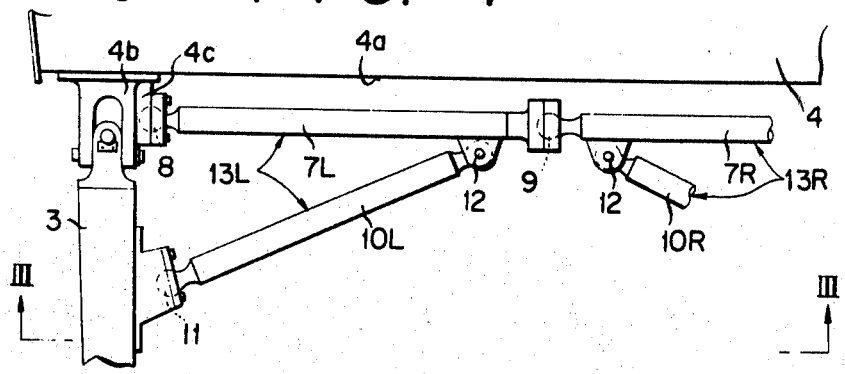
FIG. 7 is a fragmentary plan view similar to FIG. 2 but showing an alternative form of a connecting part of the diagonal braces.

FIG. 7 shows an alternative form of a connecting part of the diagonal braces in which like reference numerals numerals and characters designate corresponding parts and components in FIG. 2. In FIG. 7, a pair of struts 7L, 7R are swingably connected at their proximal ends by pivotable connection 8 to the inner sides 4*c* of the respective brackets 4*b* secured to the back of the blade 4 for pivotally mounting the distal ends of the respective arms 3. The operation of this embodiment shown in FIG. 7 is similar to that shown in FIGS. 1 to 5.

We claim:

1. In a bulldozer blade mounting including two push arms vertically swingably mounted at their proximal ends to the opposite sides of a tractor and extending forwardly, a bulldozer blade connected to the distal ends of said arms, a tilt brace extending between the top of each arm and the upper side of the back of said blade for the tilting of the blade around the longitudinal axis of said tractor, and a pair of diagonal braces each swingably connected at its proximal end around an axis parallel to the longitudinal axis of the respective arm on the inside of the respective arm and extending inwardly toward each other so as to be connected to each other at the distal ends thereof, the improvement wherein said pair of diagonal braces are connected to each other at their distal ends by a universally pivotable means and the location of said universally pivotable means is so selected that it lies at a level higher than the plane including the swingable connection of said proximal ends of said diagonal braces to said arms.

2. Bulldozer blade mounting according to claim 1, wherein each of said diagonal braces comprises a first strut pivoted at its proximal end to the respective arm and extending substantially parallel to said blade and a second strut pivoted at its proximal end to the respective arm rearwardly of said first strut and converging forwardly to join at its distal end said first strut generally centrally of said blade with said distal end of the respective first strut being joined each other by said universally pivotable means.

3. Bulldozer blade mounting according to claim 1, wherein each of said diagonal braces comprises a diagonal plate generally in the form of a right angled triangle with one of the two sides forming the right angle being adjacent to and in parallel to the respective arm and swingably connected thereto at least two spaced points and the innerwardly directed apex of said diagonal plate is connected by said universally pivotable means.

* * * * *